US006758172B2

(12) United States Patent
Morgan et al.

(10) Patent No.: US 6,758,172 B2
(45) Date of Patent: Jul. 6, 2004

(54) METHOD OF ENGINE COOLING

(75) Inventors: Guy Richard Morgan, Chelmsford (GB); James Richard Vanschagen, Burnham On Crouch (GB); Kevin Paul Cutts, Horndon on the Hill (GB); Martin Green, Billericay (GB); Nicholas Harmer, Cheam (GB); Simon Petrovich, Ditton Fields (GB)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/213,692

(22) Filed: Aug. 7, 2002

(65) Prior Publication Data

US 2003/0079698 A1 May 1, 2003

(30) Foreign Application Priority Data

Oct. 31, 2001 (EP) ..... 01309211

(51) Int. Cl.[7] ..... F01P 7/16
(52) U.S. Cl. ..... 123/41.08
(58) Field of Search ..... 123/41.04, 41.05, 123/41.06, 41.07, 41.08, 41.09, 41.1; 236/34–35.3

(56) References Cited

U.S. PATENT DOCUMENTS 4,337,733 A 7/1982 Hirata et al. ..... 123/41.1
4,577,594 A * 3/1986 Hayashi et al. ..... 123/41.08
5,561,243 A 10/1996 Machida ..... 73/118.1
5,619,957 A 4/1997 Michels ..... 123/41.44
2001/0020452 A1 9/2001 Suzuki et al. ..... 123/41.1

FOREIGN PATENT DOCUMENTS

| | | | |
|---|---|---|---|
| EP | 0 889 211 | * | 1/1999 |
| EP | 1 035 306 | | 9/2000 |
| FR | 2 455 174 | | 11/1980 |
| FR | 2 456 838 | | 12/1980 |

* cited by examiner

*Primary Examiner*—Andrew M. Dolinar
(74) *Attorney, Agent, or Firm*—Brinks Hofer Gilson & Lione

(57) ABSTRACT

This invention relates to a method of cooling an engine for an automobile, in particular to a method of operating a cooling system having a variable coolant flow control valve. The cooling system is operated in dependence upon the difference between a desired operating temperature and a measured operating temperature. If this difference falls within a first and a second predetermined threshold, the temperature control is effected by operation of the valve in dependence upon the difference. The method also includes operation of a variable speed fan and a variable speed pump, in dependence upon the difference between a desired operating temperature and a measured operating temperature.

12 Claims, 6 Drawing Sheets

METHOD OF ENGINE COOLING

TECHNICAL FIELD OF THE INVENTION

This invention relates to a method of cooling an engine for an automobile, in particular to a method of operating a cooling system having a variable coolant flow control valve.

BACKGROUND OF THE INVENTION

In a typical motor vehicle cooling circuit, coolant passes through a jacket surrounding the vehicle engine and its temperature rises. It then passes through the radiator, entering the radiator through a manifold and then passing through cooling tubes where air flows over the tubes to remove heat from and to reduce the temperature of the coolant before the coolant is re-circulated via a second manifold to the vehicle engine.

Cooling systems generally have a coolant pump for pumping coolant through the engine coolant circuit. A valve is conventionally provided to prevent coolant circulating through the radiator whilst the engine is warming up. The cooling system usually includes a fan for blowing air over the radiator in the event that the coolant becomes too hot when the speed of the automobile does not provide the necessary cooling air flow over the radiator.

Known methods of cooling engines usually include controls based on output of a thermostatic device for opening and closing the valve and for switching the fan on and off. The speed of the water pump is generally operated in dependence upon the engine speed.

The problem with such known systems is that it is difficult to operate the engine at calibratable optimum temperatures, and thus fuel consumption, power consumption and emissions are worse than optimum.

SUMMARY OF THE INVENTION

This invention seeks to alleviate the aforementioned problems.

According to the present invention there is provided a method of controlling an engine cooling system for an automobile, the cooling system comprising a variable coolant flow control valve for controlling the amount of coolant direct to the heat exchanger; the method comprising the steps: measuring the temperature of the engine; comparing the measured temperature to a desired operating temperature to generate an error value and opening the valve by a variable amount according to the error value when the error value is within a range determined by a first predetermined threshold and a second predetermined threshold.

Preferably the method further comprises the steps of: fully opening the valve when the error value is outside said range and the measured temperature is greater than the desired temperature; and fully closing the valve when the error value is outside said range and the measured temperature is less than the desired temperature.

In a preferred embodiment the cooling system further comprises a variable speed fan, and the method further comprises the step of controlling the fan in accordance with a measured air speed across the heat exchanger when the measured temperature is greater than a predetermined fan-on threshold. It is an advantage if the step of controlling the fan in accordance with a measured air speed across the heat exchanger is continued until the measured temperature is less than or equal to the desired temperature, this introduces hysteresis, to avoid the fan switching on and off too frequently.

In a cooling system including an air conditioner the method further comprises the step of operating the fan in accordance with a measured air conditioning demand.

It is a further advantage if the fan is operated in accordance with a measured ambient temperature and if fan is switched off when the vehicle speed is greater than a predetermined vehicle speed.

In a preferred embodiment the cooling system further comprises a variable speed pump and the method further comprises the step of controlling the speed of the pump according to the error value, a measured engine load and a measured oil temperature.

Preferably stored data records relationships between pump speed and each of the error value, the measured engine load and the measured oil temperature, and in which the controlling step comprises selecting the highest pump speed according to any one of the relationships when the measured temperature is greater than the desired temperature; and selecting the lowest pump speed according to any one of the relationships otherwise.

In a preferred embodiment the engine operates in a warm up mode, an economy mode, a power mode or a cool down mode, and in which the desired operating temperature is dependent upon the mode in which the engine is operating.

Additional benefits and advantages of the present invention will become apparent to those skilled in the art to which this invention relates from the subsequent description of the preferred embodiment and the appended claims, taken in conjunction with the accompanying drawings.

BRIEF DESCRIPTION OF THE DRAWINGS

The invention will now be further described, by way of example, with reference to the accompanying drawings, in which.

DETAILED DESCRIPTION OF THE PREFERRED EMBODIMENT

Figure 1:
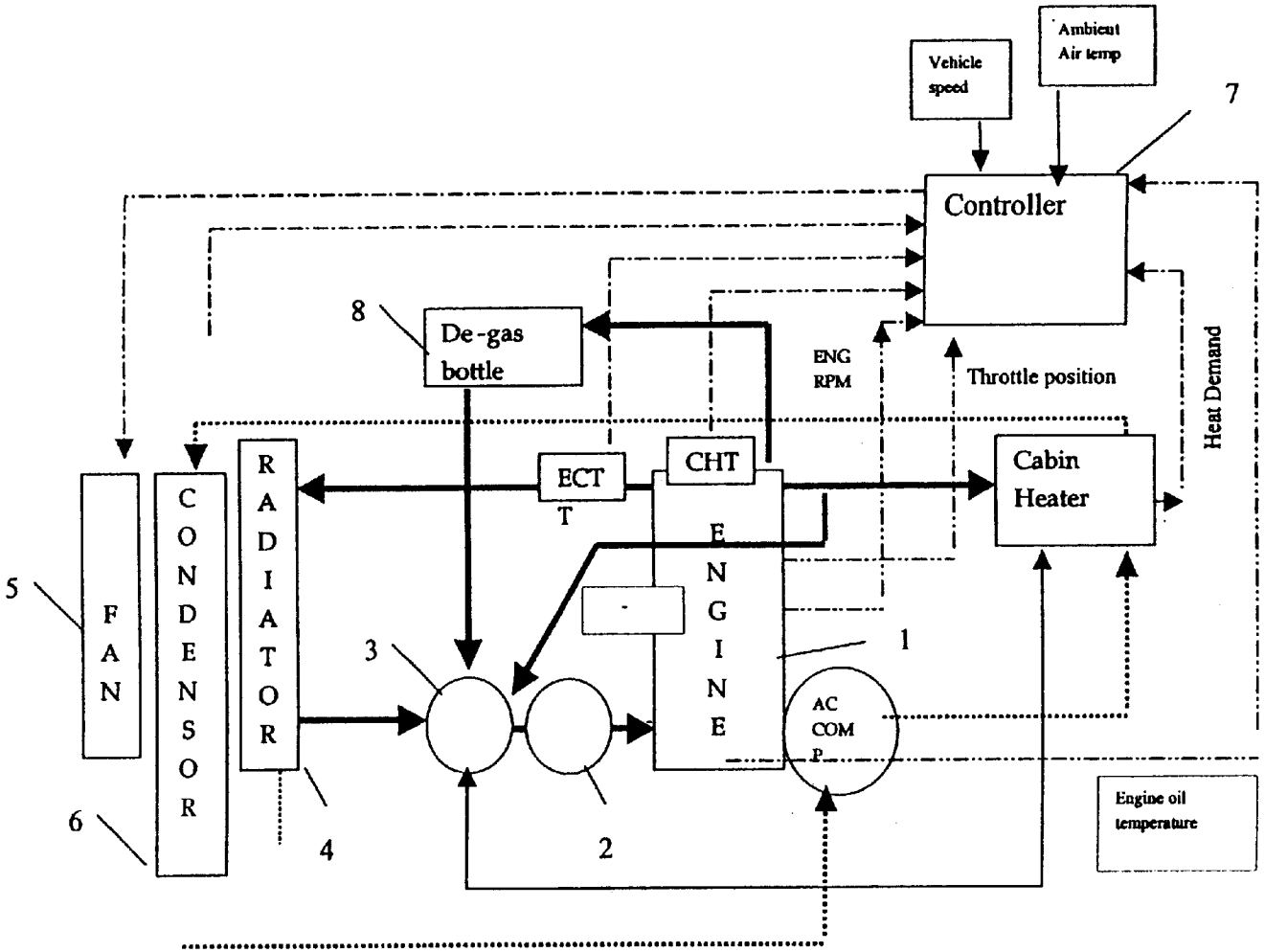
FIG. 1 illustrates schematically an engine with a controlled cooling and air conditioning system.

FIG. 1 illustrates schematically an engine 1 which has a coolant pump 2 for pumping coolant around an engine coolant circuit. A valve 3 is provided to control the amount of coolant circulating through a radiator 4. In this embodiment the valve is illustrated as being positioned between the output of the radiator and the input to an engine cooling jacket (not shown), but the valve could equally well be positioned between the output of the engine cooling jacket and the input to the radiator 4.

A fan 5 is provided for blowing air over the radiator and a condenser 6 in the event that the speed of the automobile does not provide the necessary cooling air flow for the heat exchangers (i.e. condenser 6 and radiator 4).

A controller 7 is provided which controls the fan 5, the coolant pump 2, the valve 3 and a de-gas shut off valve 8, which serves to release any accumulated air from the coolant circuit. The controller 7 is connected to receive inputs from the engine 1, namely a signal representing engine revolutions per minute, a signal indicating the current throttle position, a signal indicating the engine oil temperature and a signal indicating the cylinder head temperature (CHT) or a signal indicating the engine coolant temperature (ECT). The engine cooling system may be operated in accordance with either one or both the CHT or the ECT. In this embodiment of the invention the CHT is used. The controller 7 also receives signals from the air conditioning system indicating the condenser pressure, and from the cabin indicating the cabin heat demand. Finally for correct operation of the fan 5, signals indicating the ambient air temperature and the vehicle speed are required.

The operation of the valve 3, the coolant pump 2 and the fan 5 is based upon an error value, which is the difference between a desired operating temperature and the measured temperature, which may be either the ECT or the CHT.

The desired operating temperature of the engine 1 is determined by an operating mode that which the vehicle is in, which will be described in more detail later.

In a heat-soak mode, when the engine is turned off, if the actual or measured CHT/ECT is above a predetermined hotsoak threshold prior to switching off the engine, the flow control valve will be fully opened to allow maximum coolant to flow through the radiator. The fan 5 and the pump 2 will be switched on to a predetermined level based on the engine off temperature. The purpose of this heat-soak mode is to reduce the temperature of the engine once the engine has been switched off and prevent engine thermal stresses and over expansion of coolant. The fan 5 and pump 2 will run for a specified time and speed based upon the difference between ambient temperature and the actual measured engine temperature when the engine is switched off. In this mode there is no desired operating temperature.

In a warm-up mode, when the engine temperature is below a predetermined warm-up threshold the de-gas shut off valve 8 is closed, the flow control valve 3 is closed, so as not to allow any coolant to the radiator. If cabin heat is demanded then the available energy is balanced between the engine and cabin heater such that emissions and the desired engine operating temperature are maintained where possible.

When the engine is running in economy mode the desired operating temperature is set to a high level. The de-gas shut off valve 8 is opened allowing air to escape. The speed of the coolant pump 2, the position of the valve 3 and the speed of the fan 5 are controlled by the controller 7 to maintain the engine operating temperature to within a tolerance either side of the desired operating temperature. The desired operating temperature is set to a level such that the engine and engine oil temperature are such that there is low friction and reduced emissions from the engine exhaust pipe.

When the engine RPM signal and throttle position signal indicate that the engine is running in power mode (i.e. the vehicle is in a sustained power demand situation) the engine operating temperature is automatically lowered by setting lower desired operating temperature. In power mode, this lower operating temperature protects the engine from knock and improves engine volumetric efficiency by reducing engine all temperatures. Once the engine rpm or throttle falls below a predetermined value, the desired operating temperature is reset to the higher value for economy mode.

The operation of the three main components (the flow control valve 3, the coolant pump 2 and the fan 5) will now be described with reference to FIGS. 2 to 6.

Operation of the Coolant Pump 2

In this embodiment of the invention a variable speed coolant pump is used and the coolant pump speed is determined by taking the lowest or highest value from data tables stored in a memory, depending upon whether the measured temperature is above or below the desired operating temperature.

In other embodiments of the invention a viscous clutching water pump may be used in which the degree of engagement is varied between fully engaged and disengaged allowing the water pump to run at any speed between the fixed engaged pulley ratio speed defined by engine rpm and a predefined slip limit of the viscous clutch.

Figure 2:
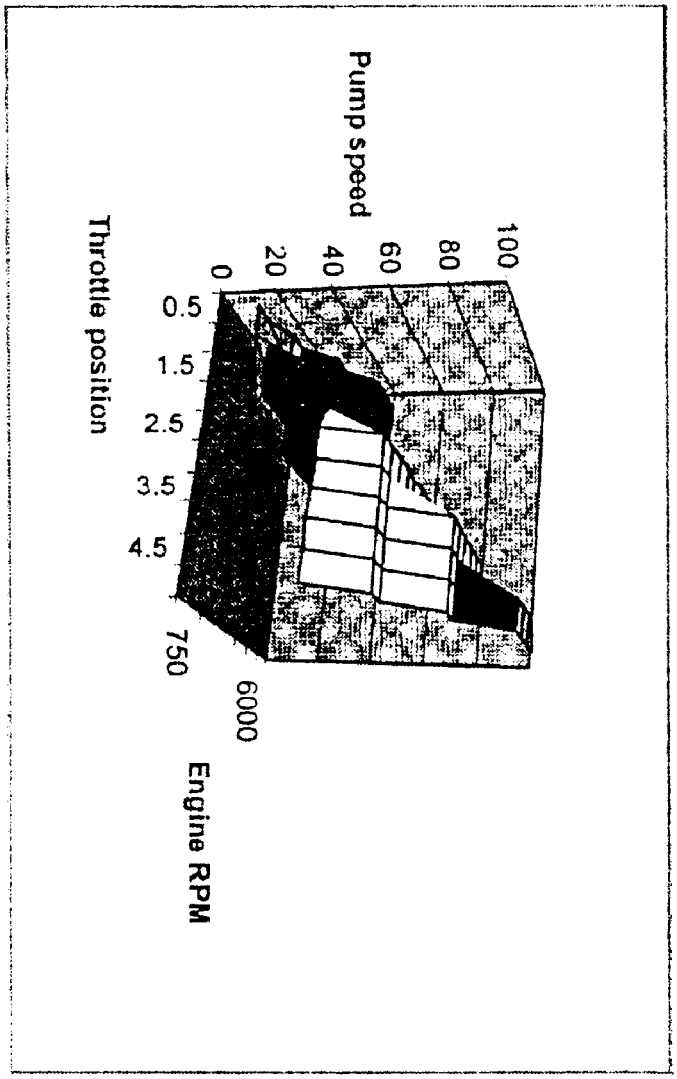
FIG. 2 is a graph showing a relationship between throttle position engine revolutions per minute and pump speed.
Figure 3:
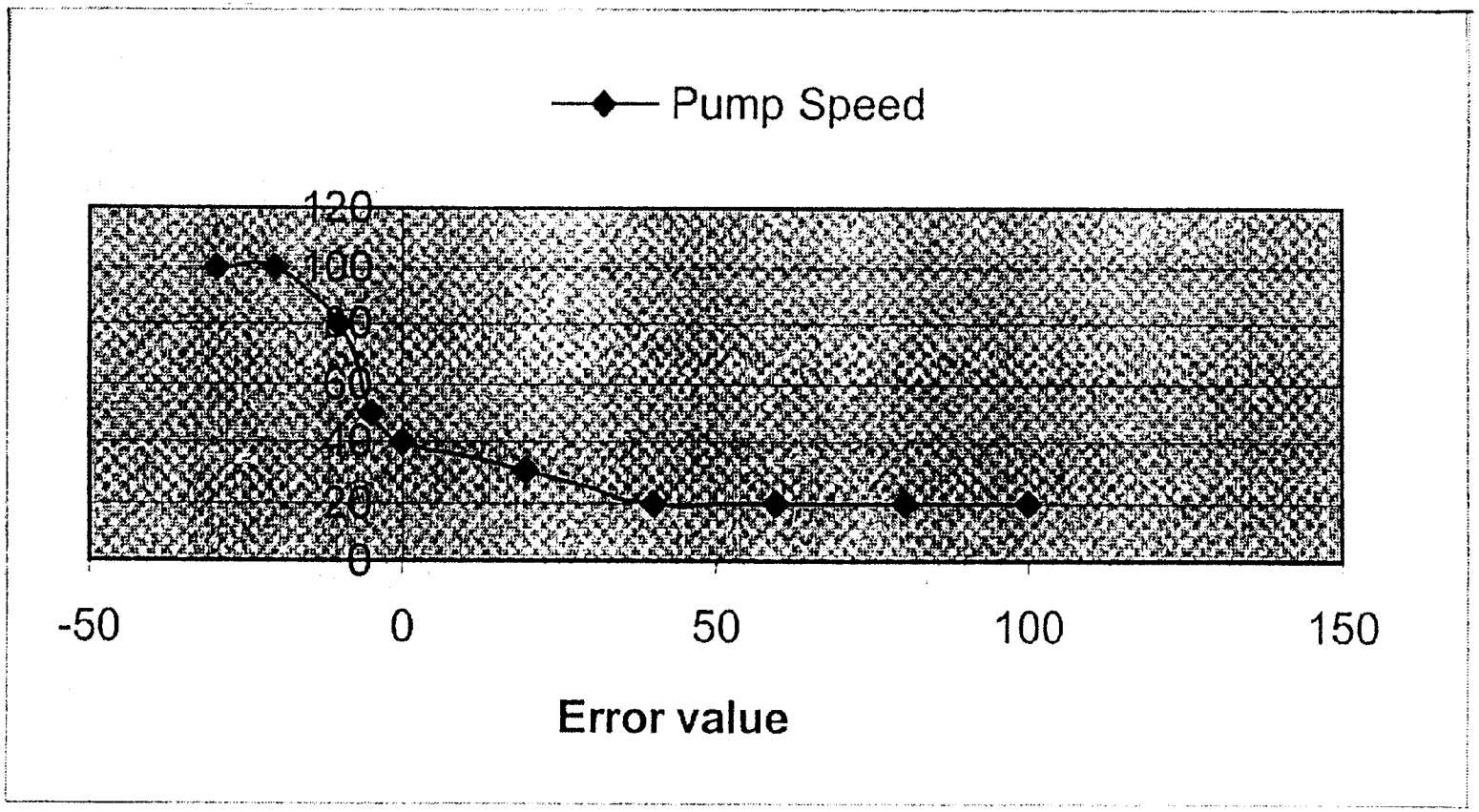
FIG. 3 is a graph showing a relationship between pump speed and a temperature error value.

There are three data tables used in this embodiment of the invention to control pump operation. The first is a data table indicating a relationship between pump speed and engine load. Engine load is a function of throttle position and engine RPM. The relationship between pump speed, throttle position and engine RPM is illustrated in FIG. 2 the pump speed increases with increasing load. The second is a data table indicating a relationship between the pump speed and the error value. FIG. 3 illustrates this relationship. As the error value indicates the engine is hotter than the desired temperature (illustrated by a negative error value in this particular embodiment) then the speed of the pump 2 is increased, as the error value indicates the engine is cooler than the desired operating temperature then the speed of the pump 2 is decreased. Finally a data table is used recording a relationship between the pump speed and transmission oil temperature (relationship not shown in the drawings) in which the pump speed increases with increasing temperature and vice a versa. In other embodiments of the invention further data tables are used recording a relationship between supplemental devices that need cooling such as power electronics for hybrid motor drivers in which the pump speed increases with increasing temperature and vice a versa.

Therefore, the pump duty is a function of the engine load, the error value and the engine oil temperature (or ancillary device that needs cooling). The function is arranged such that if the valve 3 is closed or partially closed then the pump speed will be limited, as the pump will not be pumping as much (if any) coolant through the radiator 4.

Figure 4:
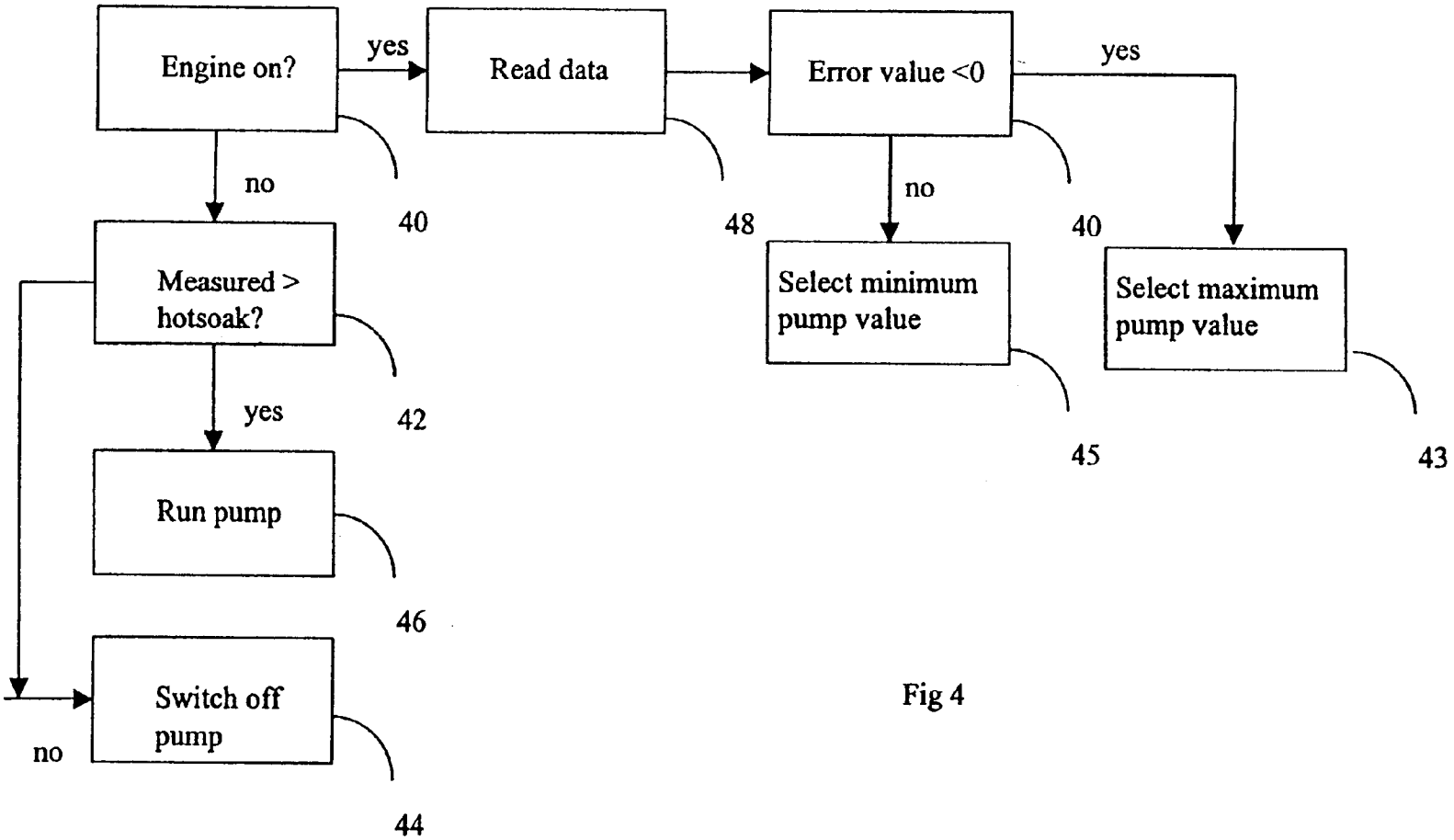
FIG. 4 is a flow chart illustrating a method of operation of a pump.

Referring now to FIG. 4, at step 40 if the engine is switched off, if the measured engine temperature is below the hotsoak threshold (checked at step 42) then the pump would not be used, and it is switched off at step 44. This avoids the pump coming on every time a moderately hot engine is switched off, thus saving power. Setting the threshold appropriately will cause the pump (and fan—as described later) to turn on after engine switch off in summer time it is really needed. If the measured temperature is found to be above the hotsoak threshold at step 42 then the pump is run at step 46 for a time period which depends upon the measured temperature.

If the engine is on, then the data is read from the data tables described above at step 48. If the error value is negative determined at step 41, then the engine temperature is above the desired engine temperature, the speed of the pump 2 is set at step 43 to be equal to the maximum pump speed indicated in any one of the data tables. If the error value is positive then the engine temperature is lower than the desired operating temperature and the speed of the pump 2 is set at step 45 to be equal to the minimum pump speed indicated in any one of the data tables.

It will be appreciated that the difference between the measured engine temperature and the desired engine temperature may be calculated such that the sign of the error value is reversed, in this case the data tables would be reversed, from those described above.

Operation of the Fan 5

The fan 5 is used to cool both the radiator 4 and the air conditioning condenser 6, therefore the fan 5 is controlled according to both the engine cooling requirement and the air conditioning cooling requirement.

Figure 5:
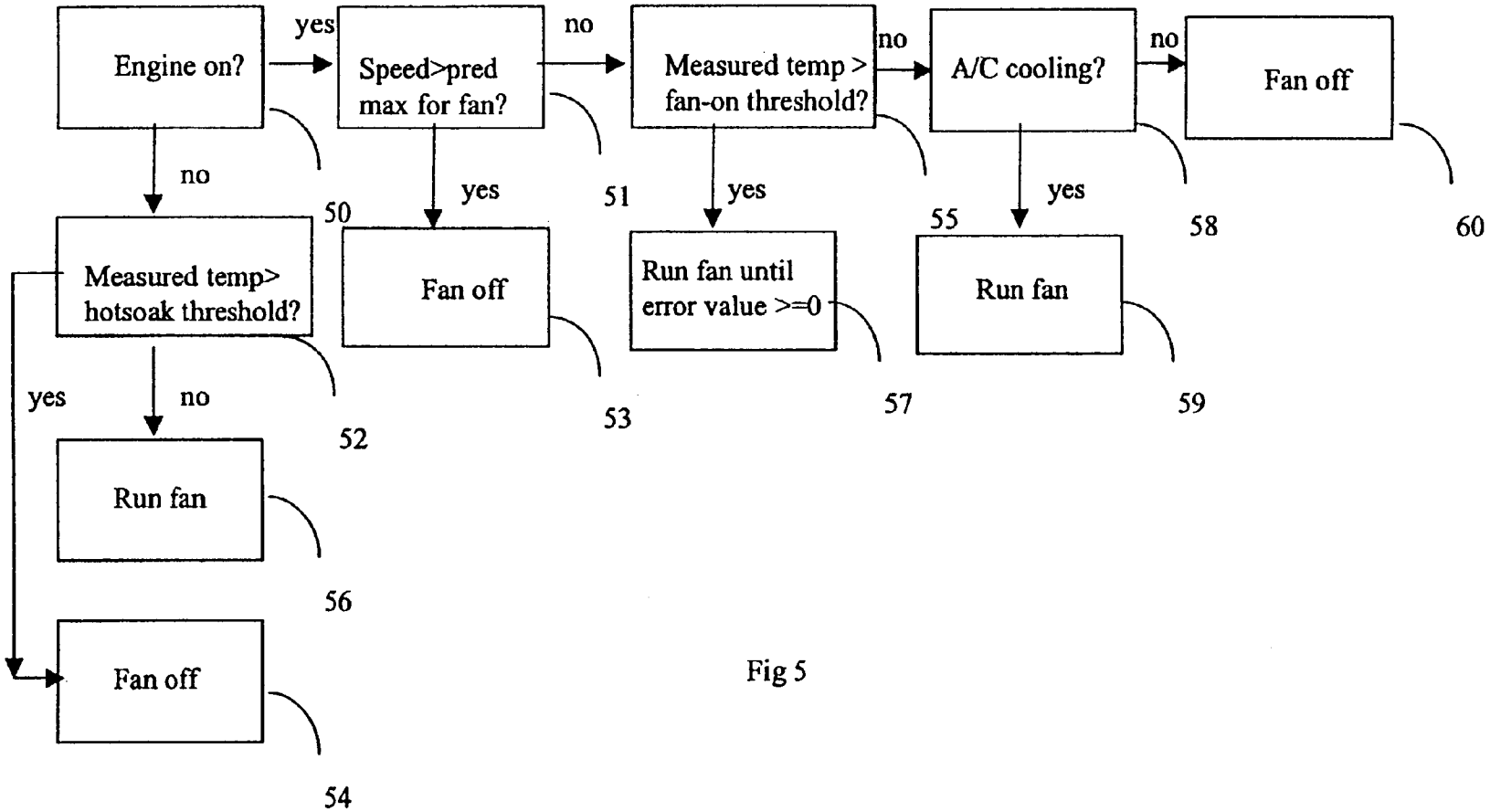
FIG. 5 is a flow chart illustrating a method of operation of a variable speed fan.

Referring now to FIG. 5, in a similar manner to the operation of the pump, when the engine is switched off, determined at step 50, if the error value is negative but the engine temperature is below the hotsoak threshold determined at step 52 then the fan would not be used, and is switched off at step 54. This avoids the fan coming on every time a moderately hot engine is switched off, thus saving power. Otherwise the fan is run for a predetermined time interval at step 56 in dependence upon the measured temperature.

Above a predetermined vehicle speed determined at step 51 the fan is disabled at step 53 as it would no longer be effective and would cause the radiator performance to deteriorate with further increasing speed, the predetermined speed at which this occurs may be set for a particular vehicle.

Otherwise the fan 5 is turned on when the measured temperature is greater than a fan-on threshold determined at step 55 indicating that the engine is becoming too hot. The fan 5 does not come on immediately when the temperature rises above the desired temperature, as this can result in too frequent switching. Furthermore, the valve 3 is used to control the temperature within a range around the desired temperature, as will be described later. The fan 5 is also turned on when the condenser pressure increases above a predetermined threshold and air conditioning has been requested by the driver. The speed of the fan 5 is determined according to the signals indicating vehicle speed and the ambient temperature such that the air speed across the radiator is greater than that generated by vehicle motion.

In this way the power consumption of the fan 5 is reduced at low vehicle speeds. If the vehicle is too hot and the vehicle is stationary the fan may only come on at a low speed as this is all that is required. However should the vehicle be moving then the fan speed will be set to match the effect of the vehicle speed and then will be increased to a value depending upon the error value and the ambient temperature to achieve the necessary additional cooling at the current ambient temperature.

At step 57, once the error value indicates that the vehicle is no longer too hot (i.e. the error value rises to 0) the fan is switched off unless the pressure of the condenser 6 is greater than the predetermined threshold indicating that condenser cooling is required.

If air conditioning condenser cooling is required, determined at step 58 then the speed of the fan 5 will be set at step 59 in dependence upon the pressure of the condenser 6 in order to maintain performance of the air conditioning system. If the vehicle speed is sufficient that the condenser pressure drops to less than the predetermined threshold then the fan 5 is switched off. Otherwise, the fan speed is set to a value greater than the vehicle speed (again also in dependence upon the ambient temperature) until the condenser pressure drops to less than the predetermined threshold.

If no air conditioning cooling is required as determined at step 58 then the fan is switched off at step 60.

Operation of the Valve 3

Figure 6:
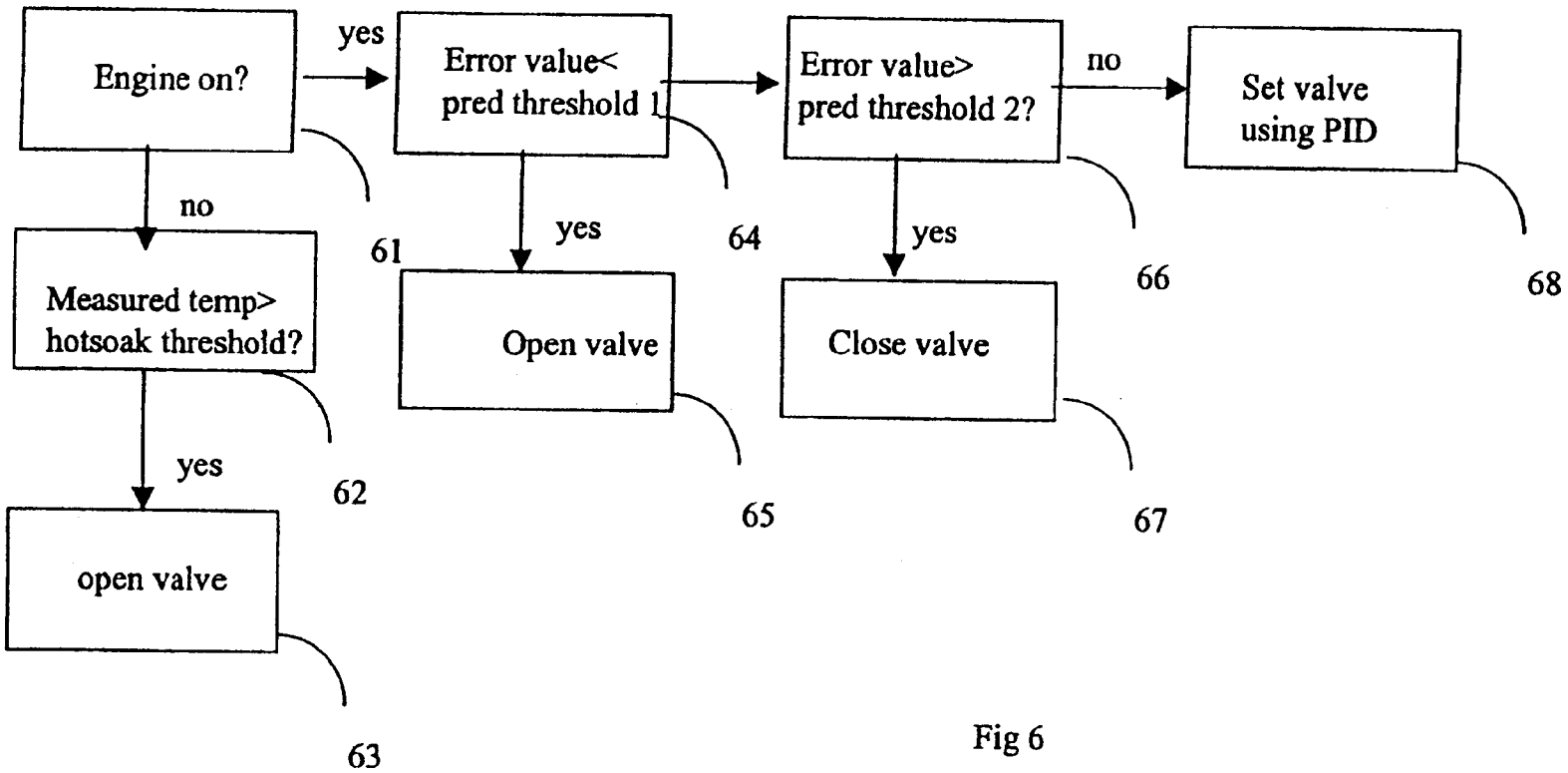
FIG. 6 is a flow chart illustrating a method of operation of a flow control valve.

The valve 3 is controlled in dependence upon the error value as illustrated in FIG. 6. In a similar check as for the pump and the fan, if the engine is switched off determined at step 61, then if the measured temperature is greater than the hotsoak threshold at step 62 the valve is opened at step 63 in order to allow rapid cooling of the engine if necessary.

Otherwise, within the engine temperature range when the error value between a first and a second predetermined threshold, the angle which the valve 3 is opened performs a heat balance between the heat being generated in the engine 1 and the heat being dissipated by the radiator 4.

Outside this range if the engine is too hot, determined at step 64, the valve 3 will opened fully at step 65 allowing the coolant to flow around the radiator and if the engine is too cold, determined at step 66, the valve 3 will be fully closed at step 67.

Note that, in general, the first predetermined threshold is set such that when the error value is equal to the first predetermined threshold the measured temperature is equal to or greater than the warm-up threshold, the second predetermined threshold is set such that when the error value is equal to the second predetermined threshold the measured temperature is less than or equal to the fan-on threshold.

Within an operating range defined by the first and second predetermined thresholds the valve 3 is controlled at step 68 according to the error value using a either a Proportional Integral Derivative Controller (PID) controller or a PID controller with smith predictor to allow for the time delay in the system response, with the degree of correction being based upon the size and the sign of the error value.

As the valve is fully controllable the engine temperature can be controlled to any temperature desired by the engine control strategy and is therefore calibrateable. This degree of controllability means that the engine can be run at a higher desired operating temperatures more safely than a conventional electronic thermostat system.

Actuation Sequence

To ensure the valve 3 has full movement it is initialised when the vehicle is started, before the cooling system is enabled. If the valve 3 does not achieve full movement a failure strategy is implemented and new pump speed and fan speed and desired operating temperature are used.

If the valve 3 has full movement the pump 2 is operated as described above If the error value is within the range defined by the first predetermined threshold and the second predetermined threshold then the fan 5 is disabled and the valve 3 controls the engine temperature by opening and closing.

If the error value is very large and negative (i.e. the engine is very hot) the fan 5 is enabled the valve 3 is forced fully open so that maximum cooling is obtained through least system resistance and the valve PID controller is disabled so that the valve does not close until the system has been brought back to within allowable limits. The PID values are frozen when the system is too hot and then reset when the cooling system is back under control once control has been regained it continues on as before.

The advantages of controlling the engine cooling system according to the method described above are that amongst other things, the method may be easily integrated into a production engine control strategy. The method enables reduction of the total coolant volume and the cold circuit volume to improve engine warm up through control of the coolant flow via the valve which was previously uncontrolled. Power on demand from the driver is improved as parasitic losses from the pump and viscous fan are reduced. There is a fuel economy benefit from running at elevated temperatures during engine part load conditions (i.e. when in economy mode).

There is an improvement in the emissions the system reducing HC and CO (but not $NO_x$) as low pump speed in warm-up mode allows rapid warm up of the combustion chamber. Cabin heater performance is improved by maintaining the engine temperature when cabin heat is demanded.

The operation of a variable speed pump 2 reduces engine thermal stresses as found in alternative systems where higher temperature differentials across the engine are seen. Using this method of engine cooling, oil service interval times can be increased reducing the cost of ownership.

The foregoing discussion discloses and describes preferred embodiments of the invention. One skilled in the art will readily recognize from such discussion, and from the accompanying drawings and claims, that changes and modifications can be made to the invention without departing from the true spirit and fair scope of the invention as defined in the following claims. The invention has been described in an illustrative manner, and it is to be understood that the terminology that has been used is intended to be in the nature of words and description rather than of limitation.

What is claimed is:

1. A method of controlling an engine cooling system for an automobile, the cooling system including a heat exchanger, a variable coolant flow control valve for controlling the amount of coolant directed to the heat exchanger, and a variable speed fan; the method comprising the steps:

measuring the temperature of the engine;

measuring air speed across the heat exchanger;

comparing the measured temperature to a desired operating temperature to generate an error value;

opening said valve by a variable amount according to the error value when the error value is within a range determined by a first predetermined threshold and a second predetermined threshold; and controlling said variable speed fan in accordance with a measured air speed across the heat exchanger when the measured temperature is greater than a predetermined fan-on threshold.

2. A method according to claim 1, the method further comprising the steps of:

fully opening said valve when the error value is outside said range and the measured temperature is greater than the desired temperature; and fully closing the valve when the error value is outside said range and the measured temperature is less than the desired temperature.

3. A method according to claim 1 in which the step of controlling said fan in accordance with a measured air speed across the heat exchanger is continued until the measured temperature is less than or equal to the desired temperature.

4. A method according to claim 1 further comprising the step of operating said fan in accordance with a measured air conditioning demand.

5. A method according to claim 1 in which the step of operating the fan includes the sub step of operating the fan in accordance with a measured ambient temperature.

6. A method according to claim 3 in which the fan is switched off when the automobile has a translational speed that is greater than a predetermined automobile speed.

7. A method according to claim 1 in which the engine operates in a warm up mode, an economy mode, a power mode or a cool down mode, and in which the desired operating temperature is dependent upon the mode in which the engine is operating.

8. A method according to claim 1, the cooling system further including a variable speed pump, and the method further comprising the steps of:

measuring at least one system parameter from a group Y, wherein the group Y consists of the error valve, measured engine load, and measured oil temperature; and controlling the speed of the pump according to the measurement of the at least one system parameter from the group Y.

9. A method of controlling an engine cooling system for an automobile, the cooling system including a heat exchanger, a variable coolant flow control valve for controlling the amount of coolant directed to the heat exchanger, and a variable speed pump; the method comprising the steps:

measuring the temperature of the engine;

comparing the measured temperature to a desired operating temperature to generate an error value; and opening said valve by a variable amount according to the error value when the error value is within a range determined by a first predetermined threshold and a second predetermined threshold;

controlling the speed of the pump according to the error value, a measured engine load and a measured oil temperature.

10. A method according to claim 9 in which stored data records relationships between pump speed and each of the error value, the measured engine load and the measured oil temperature, and in which the controlling step comprises selecting the highest pump speed according to any one of the relationships when the measured temperature is greater than the desired temperature; and selecting the lowest pump speed according to any one of the relationships otherwise.

11. A method according to claim 9, the method further comprising the steps of:

fully opening said valve when the error value is outside said range and the measured temperature is greater than the desired temperature; and fully closing the valve when the error value is outside said range and the measured temperature is less than the desired temperature.

12. A method according to claim 9 in which the engine operates in a warm up mode, an economy mode, a power mode or a cool down mode, and in which the desired operating temperature is dependent upon the mode in which the engine is operating.

* * * * *